United States Patent [19]

Stahlecker

[11] 4,135,354

[45] Jan. 23, 1979

[54] OPEN-END SPINNING MACHINE WITH A MAINTENANCE DEVICE

[75] Inventor: Fritz Stahlecker, Josef-Neidhart-Strasse 18, 7341 Bad Überkingen, Germany

[73] Assignees: Hans Stahlecker; Fritz Stahlecker, both of Germany

[21] Appl. No.: 839,253

[22] Filed: Oct. 4, 1977

[30] Foreign Application Priority Data

Oct. 23, 1976 [DE] Fed. Rep. of Germany ..... 2648066

[51] Int. Cl.[2] ..... D01H 11/00; D01H 1/12

[52] U.S. Cl. ..... 57/302; 57/58.89; 57/304

[58] Field of Search ..... 57/34 R, 56, 58.89

[56] References Cited

U.S. PATENT DOCUMENTS

| | | | |
|---|---|---|---|
| 3,810,352 | 5/1974 | Miyazoki et al. | 57/56 X |
| 4,028,136 | 6/1977 | Kamp | 57/56 X |
| 4,057,955 | 11/1977 | Rochrich | 57/56 |

*Primary Examiner*—Donald Watkins
*Attorney, Agent, or Firm*—Craig & Antonelli

[57] ABSTRACT

A movable cleaning device is provided for cleaning the individual rotors on spinning assemblies of an open-end spinning machine. In order to accommodate cleaning of the rotors, with the rotor shafts being out of driving contact with their operational drives, the cleaning device is equipped with braking and/or driving means for controlling the rotational speed of the spinning rotor during cleaning operations. In this manner, cleaning elements such as rotary brushes, can be held in one position, while the relative rotational movement of the spinning rotor and the brush effects cleaning of the rotor. In certain preferred embodiments, the cleaning brush itself serves to impart rotational movement to the spinning rotor, with the drive for the brush being controllable so as to assure differential velocity of the brush and spinning rotor rotation. In other preferred embodiments, separate drive mechanisms and/or brake mechanisms are carried by the cleaning device for selective engagement directly with the spinning rotor.

12 Claims, 6 Drawing Figures

52
53
51
49
50
48
46
42
47
45
25
2
21a
18a
14a
15a
33a
41a
35a
30a
31
34a
32a
43
44
29a
39a
28
26a
16a
27a
37a
40a
36a
38a
17
24
23

OPEN-END SPINNING MACHINE WITH A MAINTENANCE DEVICE

BACKGROUND AND SUMMARY OF THE INVENTION

The invention relates to an open-end spinning machine composed of a plurality of spinning assemblies with at least one maintenance device traveling along the open-end spinning machine. The maintenance device is provided with means for opening a spinning assembly and with means for advancing a cleaning device to a spinning rotor accessible as a result of the opening of the spinning assembly and having one open side, into which spinning rotor a cleaning element of the cleaning device enters while the spinning rotor is separated from its drive means.

Commonly owned pending U.S. applications Ser. Nos. 798,380, filed May 19, 1977 (title: Mobile Cleaning Device For An Open End Spinning Machine) and Ser. No. 774,539, filed Mar. 4, 1977, now U.S. Pat. No. 4,056,832 (title: Open-End Spinning Machine With A Plurality Of Spinning Units And With At Least One Servicing Device) also relate to cleaning apparatus for open-end spinning machines and may be consulted, as needed, for a further understanding of the present invention.

In a known design of the type described hereinabove (British Pat. No. 1,306,232), a suction nozzle is advanced to the spinning rotor, said nozzle cooperating with a peeling knife which enters the spinning rotor. Since a relative velocity is necessary between the cleaning element and the spinning rotor, the fact that the spinning rotor continues running (because of its inertia) after the drive is disconnected should be utilized. However, it has been shown in practice that this running down is insufficient for effective cleaning in most cases, since the spinning rotor is additionally braked by the cleaning element. However, in order to carry out maintenance work and especially to remove and replace the spinning rotor, it is desirable for the spinning rotor to be disconnected from its drive after the spinning assembly is opened, so that in any case the drive will be disconnected during the cleaning process.

An object of the invention is to design a maintenance device for an open-end spinning machine in such form that effective cleaning can be carried out even when the spinning rotor is no longer driven during the cleaning process. The invention contemplates providing that the maintenance device is equipped with means for driving the spinning rotor in question and/or controlling the rotational speed of the spinning rotor during cleaning operations.

This design ensures that the additional expense for the maintenance device remains limited while no substantial changes need be made in the individual spinning assemblies. In an advantageous embodiment of the invention, means are provided such that the cleaning element introduced into the spinning rotor is equipped with a drive which drives the cleaning element with movements directed at least approximately in the circumferential direction of the spinning rotor. This makes it possible to use the cleaning element itself as a drive means for the spinning rotor, so that no additional drives need be provided. In order to produce a sufficient difference in the circumferential velocity of the cleaining means and the spinnng rotor to be cleaned in this design, another feature of preferred embodiments of the invention provides that the drive is provided with a device for interrupting the drive and/or changing the speed and/or reversing the direction of rotation.

According to another feature of preferred embodiments of the invention, means are provided such that the cleaning device comprises a brake which can be advanced to the spinning rotor from the outside. Actuating this brake ensures that the spinning rotor again receives a differential velocity relative to the cleaning element, in the event that it has reached the circumferential velocity of the latter.

When the cleaning element sets the spinning rotor turning, there is a sufficient difference in velocity when cleaning begins between the circumference of the cleaning element and the circumferential velocity of the spinning rotor, but the two speeds become more and more similar as cleaning proceeds. Therefore, the above-mentioned measures are designed to ensure that after a certain period of time a sufficient difference is once again produced, ensuring effective cleaning.

The measure which provides for driving the spinning rotor with the aid of the maintenance device and especially with the aid of the cleaning element has the advantage that the cleaning element, during its cleaning process, need not change its initial position radially or circumferentially relative to the spinning rotor, resulting in a simplification of the design.

These and further objects, features and advantages of the present invention will become more obvious from the following description when taken in connection with the accompanying drawings which show, for purposes of illustration, several embodiments in accordance with the present invention.

DETAILED DESCRIPTION OF THE DRAWINGS

Figure 1:
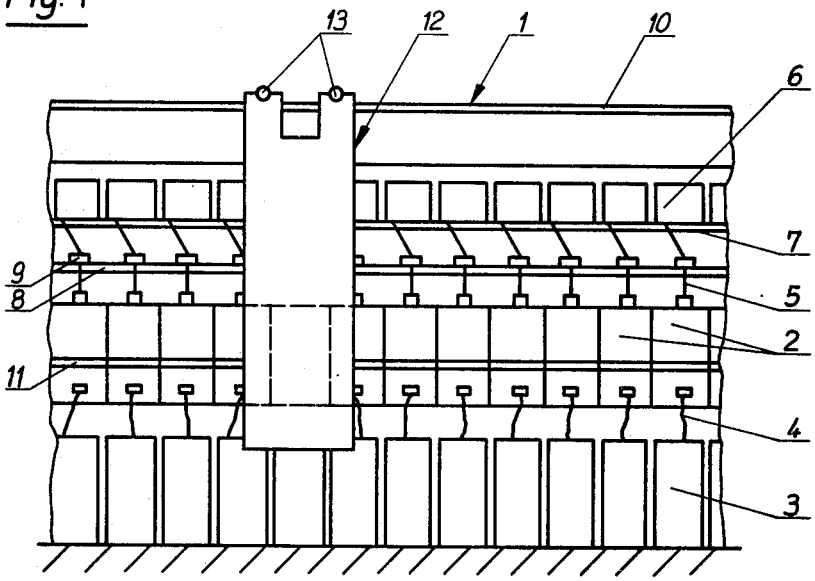
FIG. 1 is a partial schematic front view of an open-end spinning machine with a traveling maintenance device constructed in accordance with the present invention.

Throughout the various views, like reference numerals are used to designate like or similar structures. In the following description and in the drawings, certain structural features are only generally described and illustrated in order not to obscure the present invention. Given the state of the art, including other documents and applications referred to herein, those skilled in the art should be readily able to practice the invention given this disclosure.

The open-end spinning machine 1 shown in FIG. 1 is provided with a plurality of spinning assemblies 2 arranged side by side. Sliver 4 is guided to each spinning assembly 2 from a spinning cam 3, said sliver being spun in known fashion in the corresponding spinning assembly 2 and then drawn off as yarn 5. The spun yarn 5 is wound up on a take-up spool 6 driven by a friction roller 7. Yarn 5 is drawn off by draw-off rollers 8 and 9.

Tracks 10 and 11 are provided along the open-end spinning machine 1, on which tracks a maintenance device 12 travels on wheels 13, of which only the upper wheels are visible in FIG. 1. This maintenance device 12 comprises a cleaning device for the spinning rotors of spinning assembly 2. Maintenance device 12 is preferably designed in the form of an independently traveling device or as a device which, in addition to other apparatus for carrying out other maintenance tasks, comprises a cleaning device with corresponding adjustment and drive means.

Figure 2:
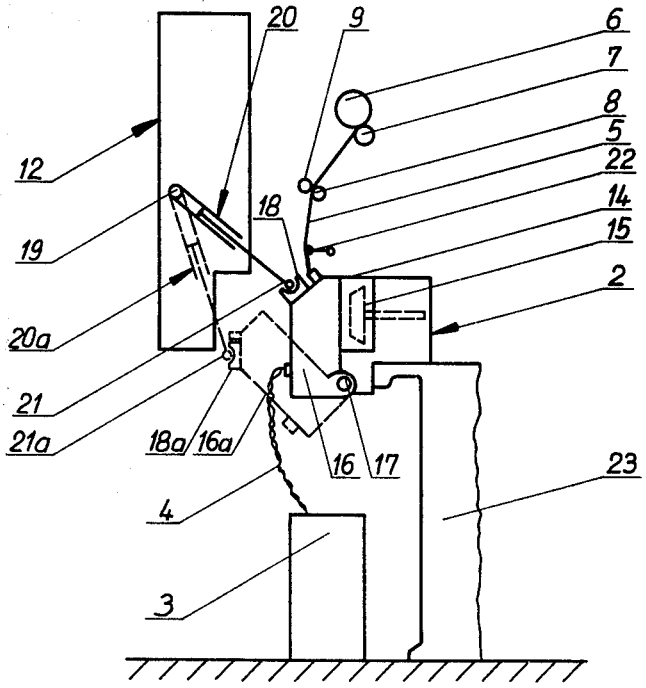
FIG. 2 is a partial schematic cross sectional view through an open-end spinning machine with a shematic representation of a maintenance device constructed in accordance with the present invention.

In FIG. 2, maintenance device 12 is shown schematically in a servicing position adjacent a spinning assembly 2. Spinning assembly 2 in the example shown is provided with a housing 14, mounted on machine frame 23 and containing a high-speed spinning rotor 15. A housing or cover 16, swivelable about an axis 17, is disposed in front of housing 14, whereby the swiveling of this cover 16 results in opening of the spinning assembly exposing spinning rotor 15. Cover 16 also preferably comprises a feed and opening device for card sliver 4 which swivels away with the cover 16. In FIG. 2, the partially swung away cover is represented by dashed lines and designated by reference numeral **16*a***.

Traveling maintenance device 12 is equipped with means 20 for opening spinning assembly 2, represented as a piston-cylinder unit swivelable about an axis 19 and meshing with a ball 21 into a corresponding guide 18 on cover 16 of spinning assembly 2. After it is opened, the means 20 assume the position **20*a* (represented by dashed lines in FIG. 2), wherein ball guide 18*a* and hence cover 16 are held in the open position 16*a* by means of the ball designated as 21*a***.

Figure 3:
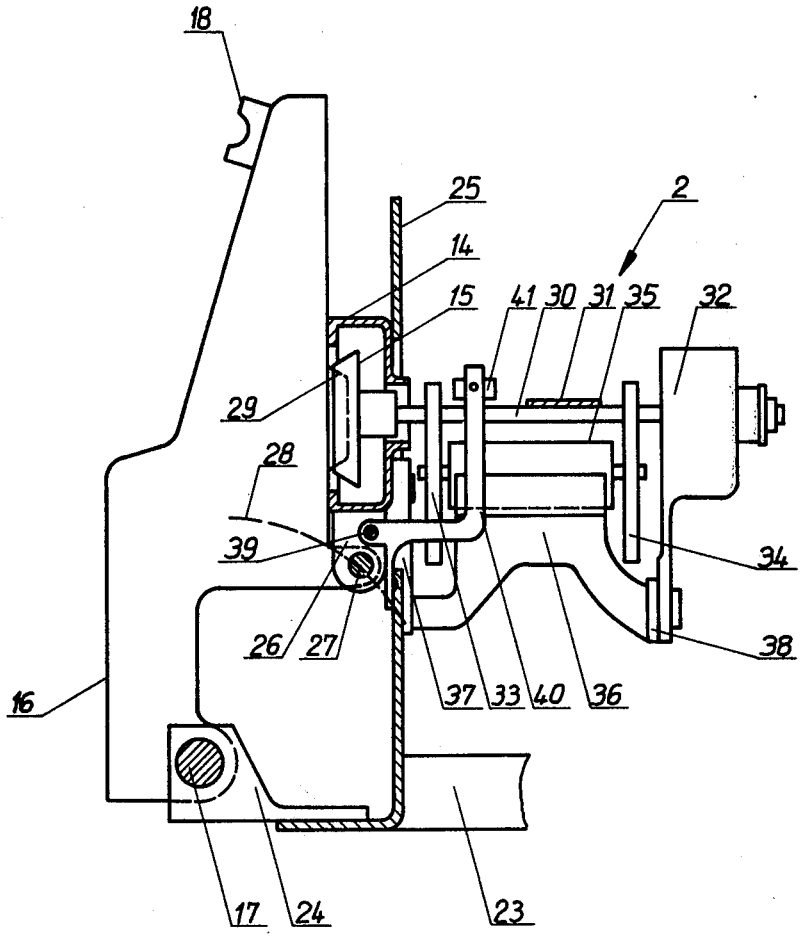
FIG. 3 is a partial cross sectional enlarged view through an open-end spinning machine, with the spinning assembly closed.

FIG. 3 shows an open-end spinning assembly 2 in somewhat more detail than in FIG. 2. Spinning assembly 2 consists essentially of a cover 16 comprising feed and opening devices for the card sliver (not shown), said cover 16 being swivelable to open spinning assembly 2 of rotor housing 14 for maintenance purposes. A wall 25, mounted in a stationary position on machine frame 23, accepts via fastening means 24, a swivel axis 17 mounted in a stationary position and extending in the lengthwise direction of the machine, about which axis 17 cover 16 can swivel (see also FIG. 4). An additional swivel axis 27 is provided on cover 16, said axis 27 describing a path 28 during the opening movement of cover 16, said path 28 being in the form of an arc when viewed in cross section about swivel axis 17. Swivel axis 27, which swivels with cover 16, supports rotor housing 14 via holder 26. Both swivel axes 17 and 27 are parallel to one another and run along the length of the machine. In order to keep the spinning assembly closed when it is in operation, a locking device, not shown in FIG. 3, is provided.

Rotor housing 14 serves to accept a high-speed spinning rotor 15, in whose open front a projection 29 of housing 16 projects, said projection 29 comprising (in a manner not shown) the opening of a thread-feed channel and the beginning of a thread draw-off channel. Spinning rotor 15 is guided by an annular collar through the open rear wall of rotor housing 14 and mounted in supporting roll pairs 33, 34 by means of a shaft 30. Supporting roll pairs 33, 34 are provided with a mount 35 consisting of a pillow block 36, said block 36 being attached to rotor housing 14 by a flange 37. Pillow block 36 can thus be swiveled together with rotor housing 14 about movable swivel axis 27. In addition to mount 35 for supporting roll pairs 33, 34, pillow block 36 also accepts a housing 32, via a holder 38, for an axial step block of rotor shaft 30, not described in greater detail. Rotor shaft 30 is driven in the operating state by a tangential belt 31 extending through the open-end spinning machine, said belt resting on rotor shaft 30 from above and pressing it into the V-shaped groove in supporting rollers 33, 34. Since pillow block 36 together with supporting roll pairs 33, 34 and rotor shaft 30 are swiveled away from tangential belt 31 upon braking (see also FIG. 4), means are provided such that when spinning assembly 2 is completely open a brake 41 grips rotor shaft 30 radially. This brake 41 is swivelably mounted to move about a pivot 39 by means of a 90° lever 40 on holder 26. In the case in which cover 16 is opened only partially for cleaning (see FIG. 4), it is not necessary to press brake 41 against rotor shaft 30, since the rotor shaft rests against step block 32 because of its tilted position and therefore remains held in position. If necessary, an additional pressure roller can be provided to keep it in the proper radial position in this case.

Figure 4:
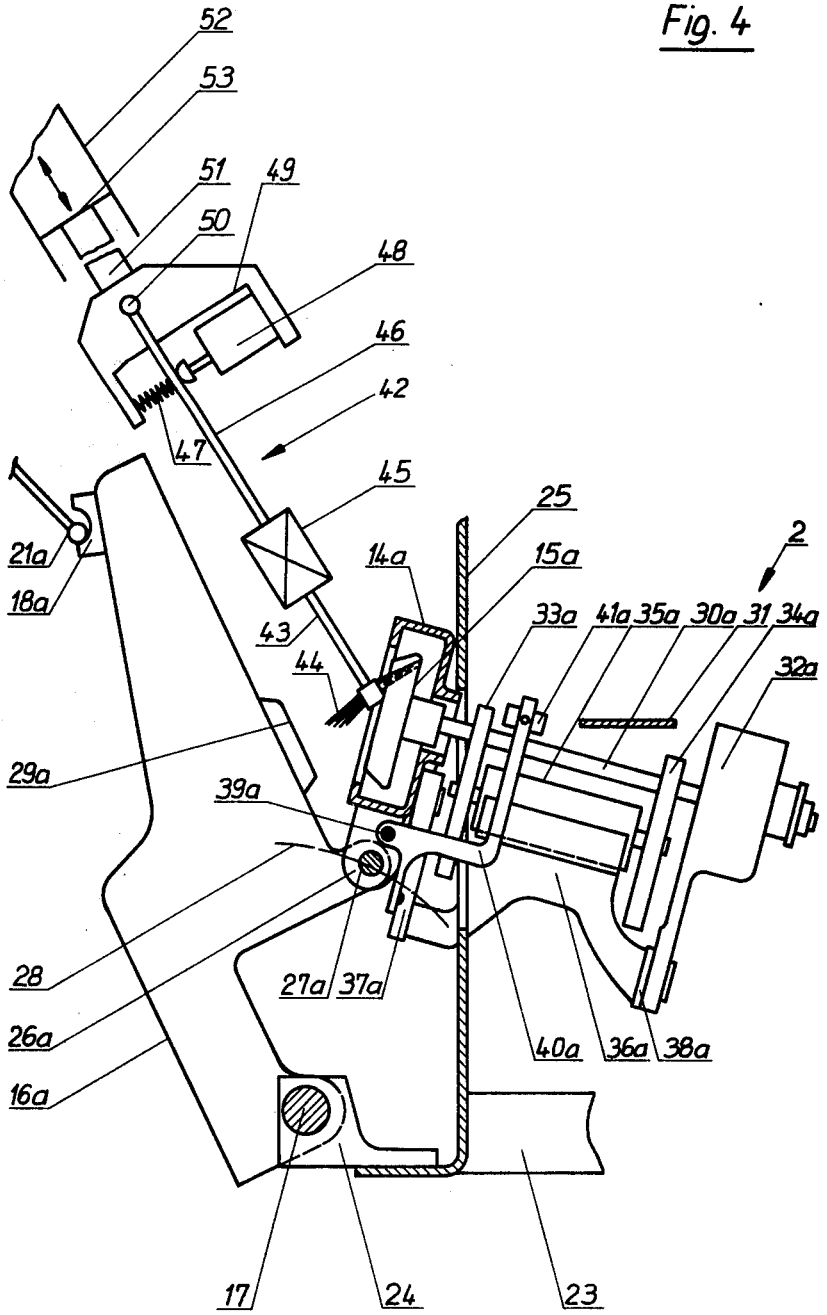
FIG. 4 is a partial cross sectional view through the spinning assembly in FIG. 3 but showing the assembly in the open state, with a cleaning element of the maintenance device introduced into the spinning rotor.

FIG. 4 shows the spinning assembly 2 of FIG. 3, with cover **16*a* in the partially open position. The same reference numbers are used in FIG. 3 as in FIG. 4, with the difference that all of the components which adopt a different position when spinning assembly 2 is open are marked with a suffix "a". It is clear that shaft 30*a* of spinning rotor 15*a* is released on the one hand from tangential belt 31 and on the other hand, however, is still not yet braked by brake 41*a*. In this intermediate position, spinning rotor 15*a* can run down with cover 16*a* partially open and come to a stop after a certain period of time. In this partially open position of spinning assembly 2, a cleaning device 42 on traveling maintenance device 12 can be advanced to spinning rotor 15*a*. If shaft 30*a* of spinning rotor 15*a* were braked during the cleaning process, the cleaning device 42 would have to be displaceable not only axially but also would have to be displaced parallel to itself during the cleaning process, so that the spinning rotor would be cleaned over its entire inside circumference, especially its thread-collecting groove. In order to save this expense, means are provided such that the spinning rotor 15*a*, now not driven by the machine, is left unbraked and is driven momentarily instead by the cleaning device 42. Cleaning device 42 consists essentially of a cleaning brush 44 which is introduced into spinning rotor 15*a*, said brush 44 being driveable by means of a shaft 43 of a motor 45. Cleaning brush 44 of cleaning device 42 is arranged so that its bristles, which come in contact with spinning rotor 15*a*, move approximately in the circumferential direction of spinning rotor 15*a*, so that they drive spinning rotor 15*a* during the cleaning process by friction, whereupon changes in speed and direction, or switching the motor 45 on and off, or the like, ensure that the cleaning brush 44 always has a differential velocity relative to spinning rotor 15*a*** in order to ensure a good cleaning action.

In addition to cleaning brushes 44, drive shaft 43, and motor 45, cleaning device 42, shown only schematically, has a shaft 46 mounted in a holder 49 and swivelable about a pivot 50. Shaft 46 can be swiveled by an actuating element 48, shown in the form of a lifting piston magnet, against the pressure of spring 47 about pivot 50; this allows cleaning brush 44 to be inserted more easily into spinning rotor 15*a* and allows it to be shifted radially with respect to the latter. Holder 49 is mounted on a piston rod 51, whose piston 53 is movable back and forth in a pneumatic cylinder 52. In this manner, cleaning device 42 is adjustable with respect to spinning assembly 2 when cover 16*a* is open at an angle of approximately 45° to the rotor axis from above.

Figure 5:
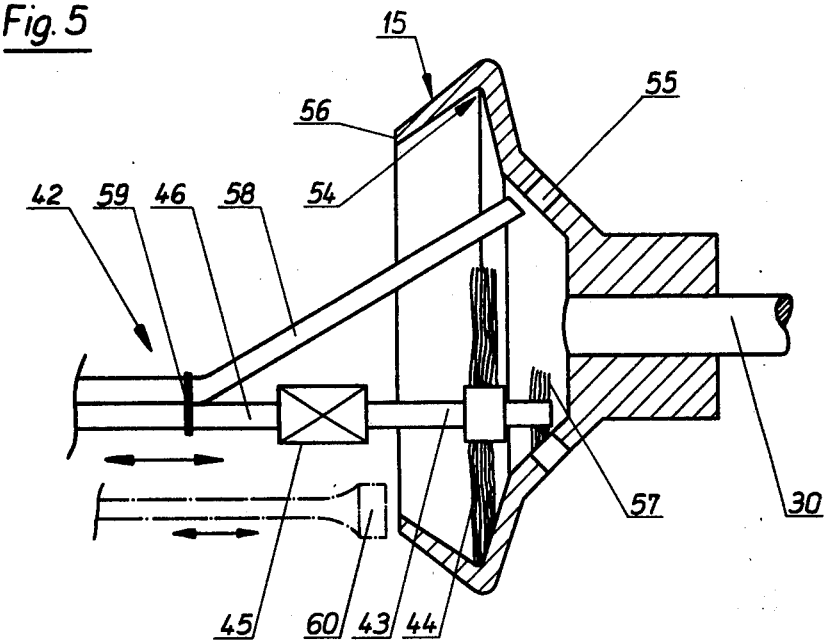
FIG. 5 is an enlarged partial sectional view of a spinning rotor with another embodiment of a cleaning element of the maintenance device introduced thereinto.

FIG. 5 shows the spinning rotor 15, into which a multiple cleaning element of a cleaning device 42 is introduced. Shaft 30 of rotor 15 is neither driven nor braked by the machine. Cleaning device 42, which is adjustable in the direction of the double arrow, comprises two cleaning brushes 44 and 57, driveable by a shaft 43 of motor 45. Brush 44 with the larger diameter can be advanced to the thread-collecting channel 54 of spinning rotor 15, while the smaller brush 57 is simultaneously advanced to the ventilation holes 55 of spinning rotor 15 and cleans them. Spinning rotor 15 is momentarily driven by friction during the cleaning process in a manner described above by the cleaning brush 44.

In embodiments in which the cleaning brushes 44 and 57 must operate at a constant speed, means are provided such that spinning rotor 15 is momentarily braked by a brake 60 adjustable by the traveling maintenance device (see the dot-dash drawing). Brake 60 can then be applied once or serveral times against the forward edge 46 of spinning rotor 15.

In addition, the cleaning device 42 of the embodiment of FIG. 5 comprises a compressed-air and/or suction nozzle 58, mounted by means of a holder 59 on axis or axle 46 of cleaning device 42. In this fashion it is possible immediately to suck away the contaminants loosened by brushes 44 and 57. Since compressed-air nozzle 58 directs the compressed air along the circumference of spinning rotor 15, the momentary drive of the spinning rotor 15 can also be accomplished by using the compressed air. Compressed-air nozzle 58 can also be directed so that it brakes spinning rotor 15, driven by cleaning brush 44, slightly and produces a differential velocity between spinning rotor 15 and cleaning brush or brushes 44 and/or 57 which is sufficient for cleaning. Instead of brake 60, a friction wheel drive can be provided according to other embodiments, of similar design and connected with a drive, which presses a friction wheel against the spinning rotor.

Figure 6:
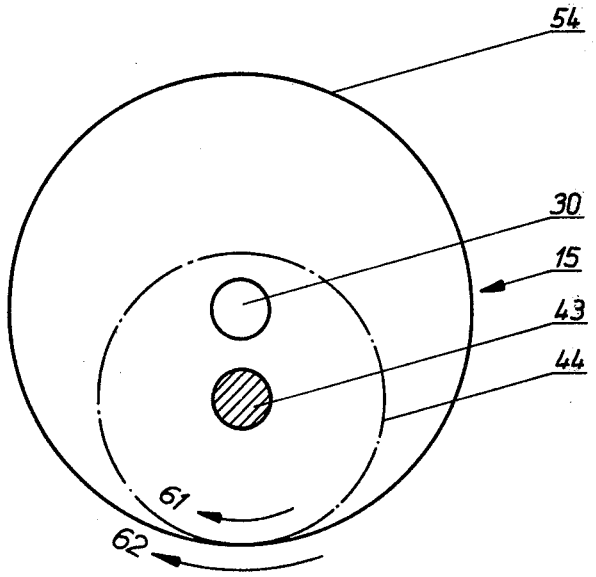
FIG. 6 is a schematic representation which shows the difference in velocity between the spinning rotor and the cleaning element.

FIG. 6 is a schematic representation of the thread-collecting channel 54 of spinning rotor 15 in the shape of an arc, whose circumferential velocity is indicated by arrow 62. In FIG. 6, the outside diameter of cleaning brush 44 is represented by a dot-dash line, whose drive shaft 43 is preferably set at a distance from axis 30 of spinning rotor 15. The circumferential velocity of the cleaning brush 44 is indicated by arrow 61. The illustration in FIG. 6 represents an instantaneous condition in which the circumferential velocity 61 of cleaning brush 44 is momentarily less than the circumferential velocity 62 of thread-collecting channel 54. Of course, at another point in time the circumferential velocity 61 of cleaning brush 44 can be greater than the circumferential velocity 62 of spinning rotor 15. Alternatively, one of the circumferential velocities 61 or 62, can be temporarily zero or can even change its rotational direction. It is merely necessary to have a difference whenever possible between the circumferential velocities 61 and 62. This ensures a good cleaning effect. It is also contemplated in this connection to equip the cleaning device with a drive fitted with a friction wheel, whereby the friction wheel is arranged so that it can be advanced to the spinning rotor, advantageously at its outside or its open edge.

Means are also provided according to still further embodiments, such that the cleaning device is equipped with an adjusting element which is advanced to the rotor brake and can release the rotor brake despite the housing being open, so that the spinning rotor can be driven by the cleaning device. In this case, the difference between the circumferential velocities of a cleaning brush or the like and the spinning rotor can be ensured by periodic actuation and release of the operating brake.

While I have shown and described several embodiments in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. Open-end spinning machine apparatus comprising a plurality of spinning assemblies and at least one maintenance device movable along the open-end spinning machine to respective maintenance positions adjacent the respective spinning assemblies, said maintenance device being provided with opening means for opening a spinning assembly and with advancing means for advancing a cleaning device to a spinning rotor provided with one open side and accessible by the opening of the spinning assembly, into which spinning rotor a cleaning element of the cleaning device is introduced while the spinning rotor is separated from its drive means, wherein the maintenance device is equipped with rotor speed control means for controlling the rotational speed of the spinning rotor being cleaned, and wherein the rotor speed control means includes a rotor brake carried by the maintenance deivce and advanceable to the spinning rotor from outside.

2. Open-end spinning machine apparatus according to claim 1 wherein the cleaning element which is introduced into the spinning rotor is equipped with a cleaning element drive, said cleaning element drive driving the cleaning element with a movement which is directed at least approximately in the circumferential direction of the spinning rotor, said cleaning element drive and cleaning element serving also as at least part of said rotor speed control means.

3. Open-end spinning machine apparatus according to claim 1 wherein the cleaning element is mounted on the cleaning device to be axially and radially adjustable relative to the spinning rotor.

4. Open-end spinning machine apparatus according to claim 1, wherein the cleaning device comprises a compressed-air nozzle advanceable to the spinning rotor, with said nozzle directing its blast at least approximately in the circumferential direction of the spinning rotor to thereby apply rotative forces to said spinning rotor.

5. Open-end spinning machine apparatus comprising a plurality of spinning assemblies and at least one maintenance device movable along the open-end spinning machine to respective maintenance positions adjacent the respective spinning assemblies, said maintenance device being provided with opening means for opening a spinning assembly and with advancing means for advancing a cleaning device to a spinning rotor provided with one open side and accessible by the opening of the spinning assembly, into which spinning rotor a cleaning element of the cleaning device is introduced while the spinning rotor is separated from its drive means, wherein the maintenance device is equipped with rotor speed control means for controlling the rotational speed of the spinning rotor being cleaned, wherein the cleaning element which is introduced into the spinning rotor is equipped with a cleaning element drive, said cleaning element drive driving the cleaning element with a movement which is directed at least approximately in the circumferential direction of the spinning rotor, said cleaning element drive and cleaning element serving also as at least part of said rotor speed control means, and wherein the cleaning element drive is provided with a speed shifting device for shifting at least one of the speed and the direction of rotation of the cleaning element drive during cleaning operations to ensure that the cleaning element has a differential velocity relative to the spinning rotor frictionally engaged thereby.

6. Open-end spinning machine apparatus according to claim 5, wherein said cleaning element is a rotating cleaning brush, capable of being advanced to a thread-collecting channel in the spinning rotor.

7. Open-end spinning machine apparatus according to claim 5, wherein the speed shifting device includes means for shifting the direction of rotation of the cleaning element drive during cleaning operations.

8. Open-end spinning machine apparatus according to claim 1 wherein the cleaning element is mounted on the cleaning device to be axially and radially adjustable relative to the spinning rotor.

9. Open-end spinning machine apparatus according to claim 5 wherein the cleaning element is mounted on the cleaning device to be axially and radially adjustable relative to the spinning rotor.

10. Open-end spinning machine apparatus comprising a plurality of spinning assemblies and at least one maintenance device movable along the open-end spinning machine to respective maintenance positions adjacent the respective spinning assemblies, said maintenance device being provided with opening means for opening a spinning assembly and with advancing means for advancing a cleaning device to a spinning rotor provided with one open side and accessible by the opening of the spinning assembly, into which spinning rotor a cleaning element of the cleaning device is introduced while the spinning rotor is separated from its drive means, wherein the maintenance device is equipped with rotor speed control means for controlling the rotational speed of the spinning rotor being cleaned, and wherein the cleaning element comprises a plurality of different diameter brushes rotatable about a common axle and associated with different areas of the spinning rotor.

11. Open-end spinning machine apparatus according to claim 10, wherein the rotor speed control means includes a rotor brake carried by the maintenance device and advanceable to the spinning rotor from outside.

12. Open-end spinning machine apparatus comprising a plurality of spinning assemblies and at least one maintenance device movable along the open-end spinning machine to respective maintenance positions adjacent the respective spinning assemblies, said maintenance device being provided with opening means for opening a spinning assembly and with advancing means for advancing a cleaning device to a spinning rotor provided with one open side and accessible by the opening of the spinning assembly, into which spinning rotor a cleaning element of the cleaning device is introduced while the spinning rotor is separated from its drive means, wherein the maintenance device is equipped with rotor speed control means for controlling rotational speed of the spinning rotor being cleaned, and wherein the rotor speed control means comprises a drive which is advanceable to the outside of the spinning rotor with a friction wheel engageable directly on the spinning rotor.

* * * * *